United States Patent [19]

Hicter et al.

[11] 4,443,004

[45] Apr. 17, 1984

[54] DEVICE FOR THE TREATMENT OF A STREAM OF ALUMINUM OR MAGNESIUM-BASED LIQUID METAL OR ALLOY DURING ITS PASSAGE

[75] Inventors: Jean-Marie Hicter, Voiron; Thierry Le Scoul, Voreppe; Serge Mairet, Monestier de Clermont, all of France

[73] Assignee: Societe de Vente de l'Aluminium Pechiney, France

[21] Appl. No.: 425,448

[22] Filed: Sep. 28, 1982

[30] Foreign Application Priority Data

Oct. 14, 1981 [FR] France ..... 81 19710

[51] Int. Cl.[3] ..... F27B 14/02

[52] U.S. Cl. ..... 266/226; 75/67 A; 75/68 R; 164/266; 266/229; 266/235; 266/240

[58] Field of Search ..... 266/226, 227, 235, 240, 266/225, 229; 164/266; 75/68 R, 67 A

[56] References Cited

U.S. PATENT DOCUMENTS

| | | | |
|---|---|---|---|
| 3,958,980 | 5/1976 | Szekely | 75/68 R |
| 4,025,060 | 5/1977 | Fujie et al. | 266/240 |
| 4,087,080 | 5/1978 | Steinegger et al. | 266/227 |
| 4,090,054 | 5/1978 | Heine et al. | 266/240 |

*Primary Examiner*—M. J. Andrews

*Attorney, Agent, or Firm*—McDougall, Hersh & Scott

[57] ABSTRACT

The invention relates to a device for the treatment of a stream of aluminum or magnesium-based liquid metal or alloy during its passage, comprising a ladle formed by an external metal casing, a refractory lining, a channel for the admission of the crude liquid metal at the rear, a nozzle for the casting of the treated liquid metal at the front, at least one internal partition leaving, with the bottom of the ladle, a space for the circulation of the liquid metal and defining a first rear compartment and at least one second front compartment opening into the casting nozzle. The ladle is fixed on a supporting cradle connected to an articulated frame relative to which the said cradle can rock forwards about a first horizontal axis passing through the casting nozzle, the articulated frame itself being connected to a fixed frame relative to which it can rock about the second horizontal axis. The first horizontal axis is approximately perpendicular to the stream of liquid metal. The second horizontal axis can be parallel or perpendicular to the first one and which includes a raisable cover, an immersion heater, an injector for agent for the treatment of the metal and a means 36 for alternately introducing and retracting the immersion heater and the injector.

12 Claims, 6 Drawing Figures

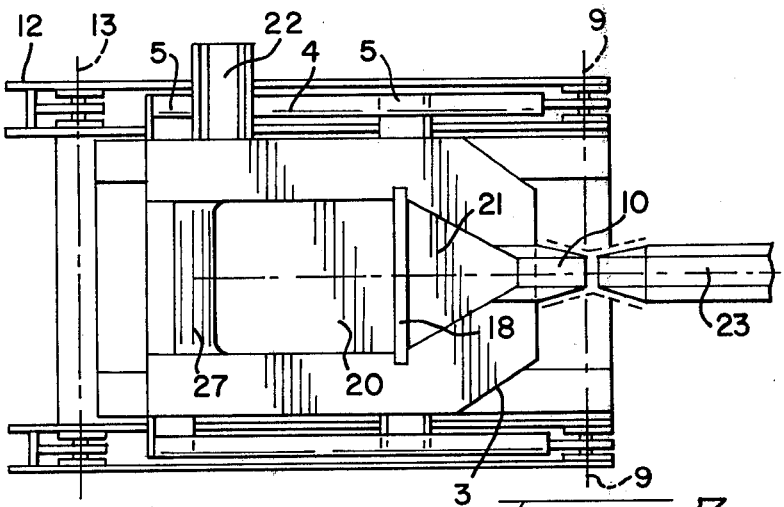
FIG. 3
FIG. 2
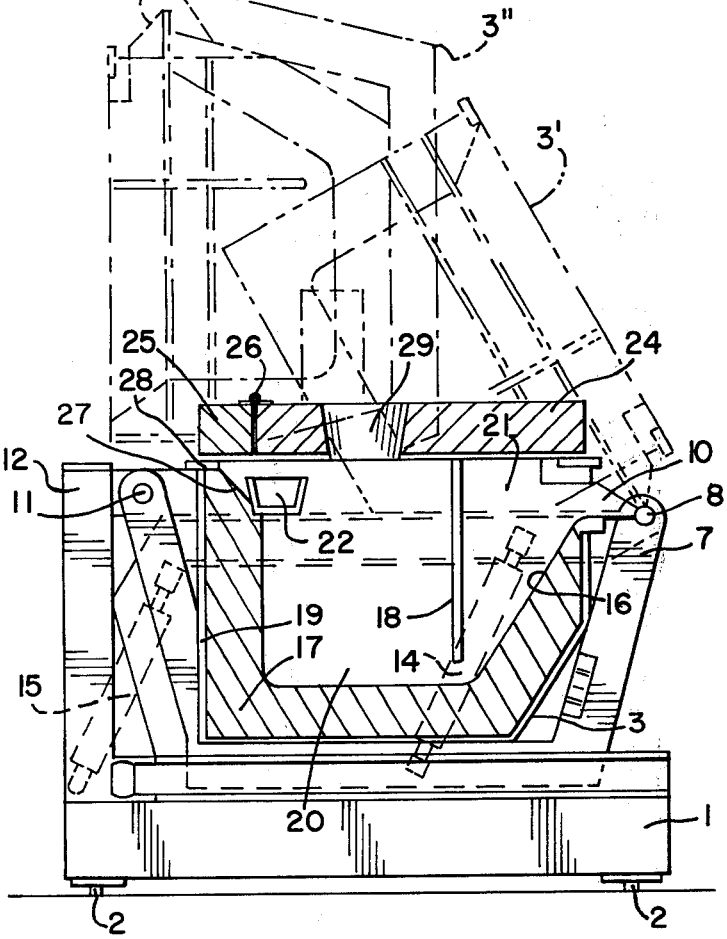

DEVICE FOR THE TREATMENT OF A STREAM OF ALUMINUM OR MAGNESIUM-BASED LIQUID METAL OR ALLOY DURING ITS PASSAGE

The present invention relates to a device for the treatment of a stream of aluminium or magnesium based liquid metal or alloy during its passage.

The word "treatment" is generally used to describe all the operations to which a crude molten liquid metal or alloy is subjected before its use in the foundry with the aim of eliminating from it the impurities and, in particular, the dissolved gases and inclusions which would impair the properties of the cast products. These operations may be of a purely physical nature, such as filtration, or physico-chemical, such as placing in contact with fluxes or with an inert or active gas divided into very fine bubbles.

At present, the requirements for aeronautical engineering, for thin strips for casings, for thin sheets for electrolytic capacitors, for fine wires for telephony or windings, oblige producers of semi-finished products made of light metals and alloys continuously to improve the quality, especially since the refinement of methods of analysis has demonstrated that microscopic inclusions, hitherto considered as negligible, could have an adverse effect on certain mechanical characteristics and increase the proportion of rejects.

Hereinafter, the term "metal" or "liquid metal" will be used to describe non-alloyed aluminium, non-alloyed magnesium and alloys based on either of these two metals.

The devices most widely used for the treatment of a liquid metal stream during its passage are "ladles", which are generally formed by a metal container with a refractory lining which may or may not be provided with a heating means which is external or integrated in the lining and which, in most cases, are divided into two compartments by a flat or circular partition. One of the compartments or both, may be filled with a filter substance, often constituted by alumina granules. One of the compartments may contain the means for injecting a gas or a mixture of inert gas (nitrogen, argon) and/or active gas (chlorine).

U.S. Pat. Nos. 2,804,463 (ALCOA), 2,863,558 (ALCOA), 5,010,712 (ALCOA), 3,025,155 (ALCOA), 3,039,864 (ALCOA), British Pat. Nos. 1,266,500 (BRITISH ALUMINIUM CO.) and 1,367,069 (BRITISH ALUMINIUM CO.) and U.S. Pat. Nos. 3,870,511 (UNION CARBIDE), 4,040,610 and 4,047,938 (UNION CARBIDE) can be cited as typical examples of the state of the art.

However, the devices currently used are not completely satisfactory both with regard to the final purity of the metal produced (content of hydrogen and of so-called "ultimate" inclusions of the order of 5 micrometers or less), and with regard to the case of use and handling: heating, cleaning, rapid passage from an alloy to a non-alloyed metal or from an alloy to another type of alloy, emptying of ladle bottoms and change of filter bed.

The invention relates to a device for the treatment of a stream of liquid metal during its passage, formed by a ladle comprising an external metallic casing and an internal refractory lining, a channel for the admission of the liquid metal at the rear and a nozzle for the casting of the treated metal at the front, and at least one internal partition leaving a space with the bottom of the ladle for the passage of the liquid metal and defining a first rear compartment and at least one second front compartment opening into the casting nozzle, the said ladle being fixed on a supporting cradle connected to an articulated frame relative to which the said cradle is able to rock forwards round a first horizontal axis passing approximately through the end of the casting nozzle, the articulated frame itself being connected to a stationary frame relative to which the said articulated frame can rock round a second horizontal axis.

The first horizontal axis is approximately perpendicular to the direction of flow of the liquid metal in the ladle.

The second horizontal axis may be parallel or perpendicular to the first one, permitting backward or lateral rocking.

The device also comprises a heating means inside the ladle which is detachable and independent of the refractory lining. It may also be equipped with means for injecting a liquid, solid, gaseous or vaporous treatment agent and means for alternately introducing and retracting the internal heating means and the means for injecting the treatment agent.

In the conventional manner, the internal lining comprises a first insulating layer having low thermal conductivity in contact with the external metallic casing and a refractory layer which is chemically inert towards the metal and the treatment agents.

The ladle may be provided with liquid metal filtration means in its second compartment.

It also comprises a sealed detachable cover of which one portion is separable or movable for removal of the sullage formed during treatment.

FIGS. 1 to 6 illustrate the device forming the subject of the invention in a non-limiting fashion.

FIG. 1 is a general three-quarter front view in perspective from which a column has been partially cut away to clarify the drawing.

FIG. 2 is a vertical section of the double rocker device.

FIG. 3 is a plan view of the ladle and of the double rocker device.

FIG. 4 is a lateral view, partially cut away.

FIGS. 5 and 6 show a rotary injector which may be used as means for injecting a treatment agent.

FIG. 1 shows the various elements forming the entire device. The subsequent Figures clarify the design details.

Figure 1:
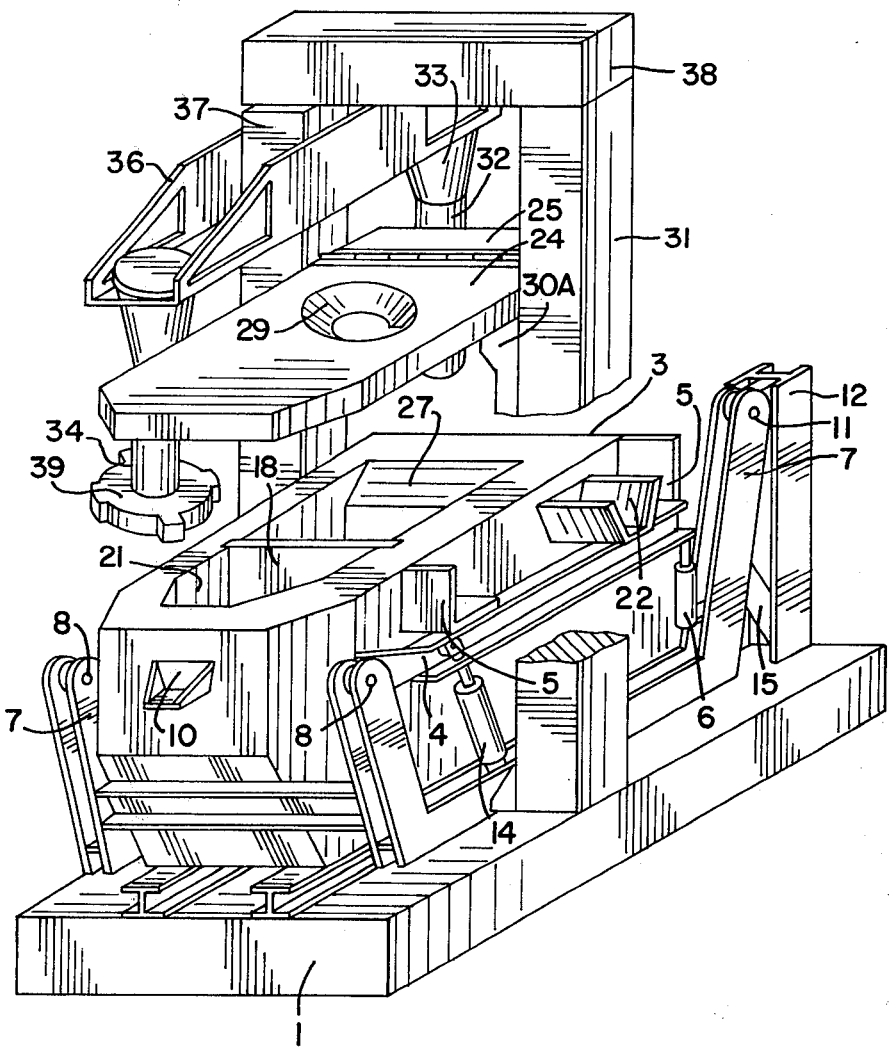
Figure 4:
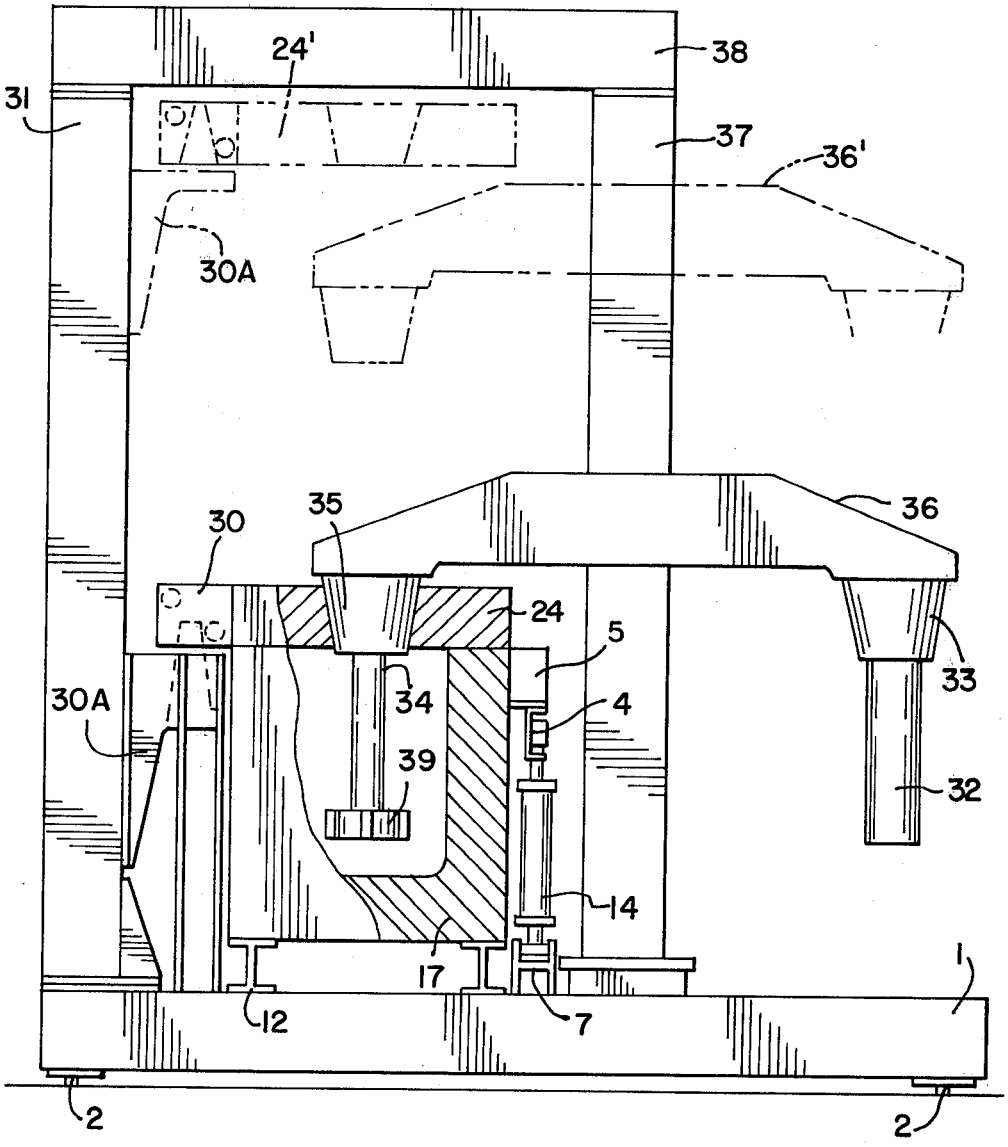

The platform 1 is a rigid element forming the main fixed frame. It preferably comprises set screws 2 for adjusting the horizontality of the assembly. The actual ladle 3 is supported by the cradle 4 formed essentially by two arms on which the ladle 3 rests via the tabs 5. It is fixed by detachable means such as bolts. Two top screws 6 permit adjustment of the horizontality of the ladle in the work position. The cradle 4 is articulated relative to the articulated frame 7 on the two bearings 8 of which the common axis 9 passes approximately via the casting nozzle 10.

The frame 7 is articulated via the two bearings 11 on two supporting elements 12 rigidly connected to the platform 1.

The axis 13 of rotation of the articulated frame 7 relative to the supporting elements 12 is horizontal and parallel to the axis of rotation of the cradle. This arrangement is not obligatory and the axis of rotation 13 of the articulated frame could also be perpendicular to the axis of rotation 9 of the cradle since the two rotational movements are controlled independently of each other by a double system of pairs of jacks 14 and 15.

The first pair of jacks 14 acting on the cradle 4 permits forwards rocking of the ladle at 3′ (indicated in broken lines in FIG. 2) about an axis passing through the casting nozzle 10. In this way, the metal contained in the ladle is completely evacuated very rapidly. The inclination of the front portion 16 of the refractory lining 17 permits this complete evacuation without standing the ladle vertically, reducing the travel required of the jack 14. The second pair of jacks 15 acting on the articulated frame 7 permits backwards rocking of the ladle to an approximately vertical position 3″ (in broken lines in FIG. 2). A work zone which is not cluttered as it is situated outside the casting zone is thus available for the careful cleaning of the ladle which is necessary when successively treating two incompatible metals or alloys which are not to be mixed and at the end of casting, ensuring the best possible quality of the treated metal in all cases. This rocking also permits inspection and repair, if necessary, of the internal lining 17 and the internal partition 18.

The rocking of the articulated frame 7 could also take place round a horizontal axis perpendicular to the forward rocking axis 9, as indicated above. Lateral rocking would then take place and would fulfill the same function and might be advantageous, depending on the arrangement of the foundry workshop, if the lateral zone were more accessible than the rear zone of the treatment device.

The internal lining 17 supported by the metal casing 19 is preferably formed in two portions: an external portion in contact with the metal casing which has low thermal conductivity and acts as an insulator and an internal portion in contact with the liquid metal which is refractory and chemically inert toward the liquid metal and the various treatment agents. The internal partition 18 defines a first compartment 20 situated at the rear of the ladle and a second compartment 21 situated at the front, the terms "rear" and "front" being taken relative to the direction of circulation of the liquid metal which enters via the channel 22 and flows out via the casting nozzle 10. In the case illustrated, the inlet channel 22 is arranged on one side of the rear compartment. If the solution involving the lateral rocking of the ladle were selected, the channel could be arranged either laterally and on the side opposite the rocking, or at the rear of the ladle.

The connection between the casting nozzle 10 and the outlet channel 23 is made by the conventional means known to foundry specialists in light alloys.

The internal partition 18 is preferably formed from a material which is a good conductor of heat for the reason explained below. It is preferably detachable without damaging the lining 17.

In the case illustrated, there is only a single internal partition. However, the ladle forming the subject of the invention can also comprise several partitions arranged in baffles defining several compartments through which the liquid metal passes successively, each compartment permitting the same treatment or a different treatment such as filtration, injection of inert or active gas, mixing with a flux, etc.

The ladle 3 also comprises a cover 24 also formed by a metal frame and a refractory and insulating lining.

The portion 25 of the cover over the rear of the ladle is preferably detachable or raisable, for example by rotation about the shaft 26. To simplify the collection of sullage formed during treatment, the rear portion 27 of the lining 17 is slightly inclined so that, once the movable portion 25 of the cover has been raised, the sullage is removed easily with simple manual scraping tools without interrupting the treatment.

The cover rests on the ladle in a substantially sealed manner owing to the gaskets 28. In this way, any gaseous products injected into the metal are evacuated merely by the inlet channel 22, making them easier to collect.

The cover 24 is provided with an orifice 29 for introducing into the ladle either a heating means or a means for injecting a treatment agent into the liquid metal, the term "agent" describing any solid, liquid, gaseous or vaporous product used for treating metal, in the sense defined above.

In the case of a large capacity ladle, the cover 24 may comprise two or more orifices 29 for the alternate introduction of several heating or injection means.

During the rocking operations of the ladle, the cover 24 is released, for example, by raising it into position 24′.

In the case illustrated, the cover is provided with a stirrup 30A connected to a mechanical or hydraulic raising device of any known type which is located in the lifting column 31 integral with the platform 1.

Owing to the well known drawbacks of the heating devices which are external or integrated in the internal lining, the device forming the subject of the invention has been provided with an internal immersion heater which is removable and independent of the internal lining, never used hitherto in existing foundry ladles. The active element of the immersion heater 32 is, for example, an electrical resistance protected by a sheath which is a good conductor of heat, is resistant to thermal impacts, sealed and chemically resistant to molten metal.

In the case of a ladle having a capacity of 600 kg of liquid aluminium, a 20 kW immersion heater allows preheating of the empty ladle from 20° to 700° C. in about 30 hours and maintenance of the temperature of the full or empty ladle at approximately 750° C. with adequate regulation. It can also permit the heating of the metal at a rate of approximately 60° C. per hour. Owing to the good thermal conductivity of the partition 18, the heater acts just as effectively on the second compartment 21.

The support of the immersion heater 32 which permits, furthermore, the passage and the protection of the supply and temperature-sensing cables, comprises a conical sleeve 33 of which the conicity cooperates with the conicity of the orifice 29 of the cover to permit precise positioning as well as a sealed join.

Similarly, the device for injecting the treatment agent 34, whatever it may be, comprises a conical sleeve 35 which fulfills the same function.

To allow rapid exchange between the immersion heater 32 and the injector 34, these two members are arranged on a manipulator 36 supported by the column 37. In the case illustrated, which is only given as a non-limiting embodiment, the manipulator is connected to a mechanical or hydraulic lifting means along the column 37 which, when the manipulator 36 is in the raised position 36′, is able to turn about its axis so that the immersion heater 32 or the injector 34 can be exchanged and replaced in the work position.

The two columns 31 and 37 are preferably connected by a horizontal cross beam 38 which can easily be detached so that the ladle 3 can be removed, if necessary, by an external handling means such as a monorail hoist, overhead crane, etc.

The design of the device forming the subject of the invention allows very great flexibility in use while permitting the employment and combination of various known processes for the ultimate purification of aluminium, aluminium-based alloys, magnesium and magnesium-based alloys.

Figure 5:
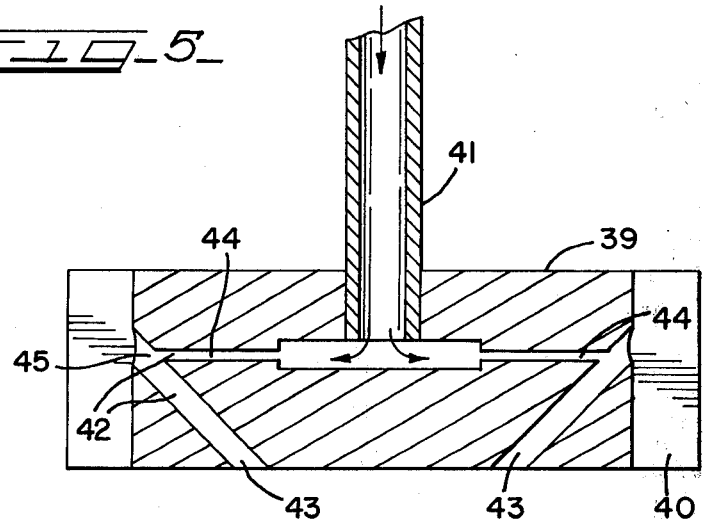
Figure 6:
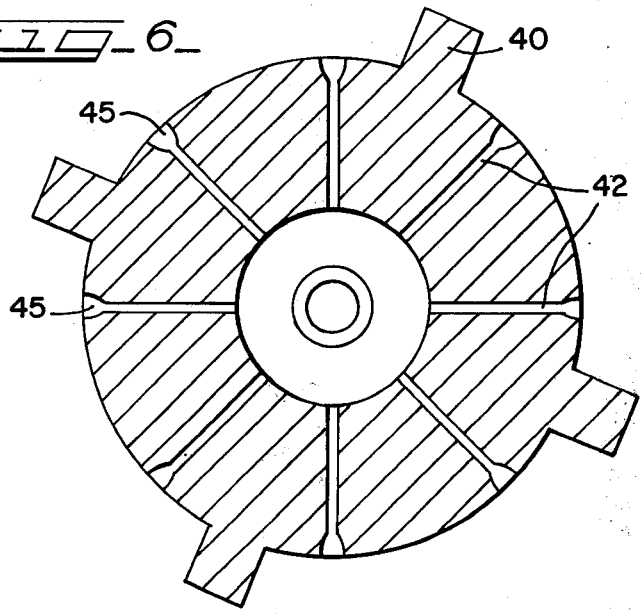

It is perfectly suitable for any devices for the injection of inert and/or active gases, which may be fixed (porous or perforated injection rods) or rotary such as those described, for example, in French Patent Application No. 2 491 954 (U.S. Pat. No. 4,397,541) which claims a rotary stirrer of which the lower end rests, during stoppage, on a gas-injection stopper placed at the bottom of the ladle and which rises under the influence of the pressure of the gas emitted via the stopper and, thus supported by a fluid bearing, under the influence of an external torque, can turn freely about its axis and allow a multitude of evenly dispersed gas bubbles to escape through the space separating it from the stopper, or again, in French Application No. 81 16 735 (U.S. application Ser. No. 402,158), which claims a rotary gas dispersion device (FIGS. 5 and 6) for the treatment of a liquid metal bath contained in a vessel comprising a cylindrical rotor 39 equipped with blades 40 immersed in the bath, connected to a hollow drive shaft 41 serving for the supply of gas. The rotor is perforated by pairs of ducts 42, each pair comprising one duct 43 for the passage of the liquid and another 44 for the passage of the gas, each of the pairs opening separately at the same point 45 on the lateral surface of the cylinder so as to form at this point a fine liquid-gas dispersion which is then distributed in the bath by means of the blades 40.

Similarly, the injector can be supplied with treatment agent from the device claimed in French Patent Application No. 81 06 134 which comprises a tank of halogenated product, which is liquid at ambient temperature, and is connected to the inlet of a metering micropump, of which the outlet merges into a vaporizer equipped with a heating means, and connected to a source of inert gas, equipped with a pressure and flowrate regulator, and a connecting pipe between the vaporizer and the injector 34.

The metal being treated in the first compartment can also receive, in a known manner, a cover of halogenated flux which is liquid or solid at the treatment temperature.

Similarly, the second compartment can receive various filtration devices such as alumina beads of sufficient granulometry or grains of flux.

Such filter beds based on grains of solid flux can be held in place and exchanged by the interchangeable cartridge method described in French Pat. No. 2 463 816 (SERVIMETAL). In such a case, the wall or portion of the wall of the cartridge can act as a separating partition between the first and second compartment.

The metal can also be filtered by using filter blocks made of sintered flux, described in French Pat. No. 2 446 862 (SERVIMETAL).

EMBODIMENT

Two treatment ladles according to the invention as illustrated in FIGS. 1 to 6 were produced.

The first has a capacity of 600 kg of liquid aluminium and is proposed for treating up to 10 tonnes/hour of metal. At this flow-rate, the average residence time of the metal in the ladle is of the order three and a half minutes. The injector used is the rotor with paired ducts described above which rotates at 150 rpm (FIGS. 5 and 6). An argon-chlorine mixture containing 5% of chlorine was injected at a rate of 4 $Nm^3/h$ for a flow-rate of 6 tonnes/hour of metal to be treated.

The second has a capacity of 2,400 kg of liquid aluminium and can treat up to 40 tonnes/hour of metal. It comprises two rotary injectors with paired ducts delivering a total of 16 $Nm^3/h$ of the same argon-chlorine mixture containing 5% of chlorine.

Tests were carried out on a 2014 alloy (Aluminium Association designation and AFNOR Standard A 02104) having the following composition:

Copper: 4.40%
Magnesium: 0.50%
Manganese: 0.80%
Silicon: 0.90%
Aluminium: remainder Estimations of hydrogen on this metal gave the following results:

before treatment: 0.75 $cm^3/100$ grammes
after treatment: 0.10 $cm^3/100$ grammes This level of 0.10 $cm^3/100$ grammes is considered at present as the desirable limit for particularly demanding uses such as aeronautical structures.

ADVANTAGES ACHIEVED BY THE INVENTION

The treatment ladle forming the subject of the invention has a certain number of decisive advantages over the ladles currently used.

In fact, it offers the following possibilities:

1. Total evacuation of the metal contained in the ladle by mere forward rocking at the end of casting, therefore without loss of metal and without the slightest risk of mixing with the metal from the following operation.

2. In the same manner: instantaneous exchange of metal or of alloy without any other manoeuvre than the forward rocking, permitting the performance of continuous or intermittent casting even with successive alloys which are incompatible with each other.

3. Ease of cleaning during the treatment via the detachable portion of the cover, which is particularly useful during long duration continues casting operations.

4. Ease of cleaning at the end treatment by backward rocking (or lateral as the case may be) of the empty ladle permitting the removal of all remains of sullage and solidified metal which might contaminate the following charge.

5. Heating system independent of the ladle, permitting its exchange or repair without interrupting the operations taking place (exchange of the immersion heater requires less than 1 hour).

6. Possibility of rapidly superheating the metal at the beginning of the casting operation.

7. The internal heater permits the use of a large thickness of refractory material and insulation and thus allows excellent thermal insulation of the tank. The gain in energy is very significant, particularly if the heater is governed by a precise regulator.

8. No limitation in the choice of the type of injector for treatment agent: any static or rotary type currently known can easily be adapted.

9. Rapid exchange of the injector and the immersion heater, permitting the desired function to be adopted at the desired moment.

10. Rapid removal and replacement of the cover whether for visual inspection, cleaning, addition of flux, etc.

11. Minimal risk of corrosion by air and treatment agents owing to the simple design and the selection of the materials 12. Easy collection of the gaseous effluents at the inlet channel.

It should be stated that the device forming the subject of the invention is particularly suitable for complete automation as it is possible to program all the manoeuvres of forward and backward rocking, raising and positioning of the cover, raising, exchange and positioning of the immersion heater and of the injector, preheating, temperature maintenance, etc., with the various necessary safety factors and prohibitions, and to centralize them on a remote console which also governs the hydraulic unit controlling the various jacks for the rocking and raising and lowering of the cover, the immersion heater and the injector.

Finally, although the invention has been described as being applicable to the treatment of aluminium, magnesium and alloys based on either of these metals, it can also be applied to other metals or alloys having a similar melting point. Zinc, lead, tin, copper and copper alloys such as bronze and brass or copper-aluminium alloys can therefore be subjected to purification and refining treatments in the device forming the subject of the present invention.

We claim:

1. A device for the treatment of a stream of aluminum or magnesium-based liquid metal or alloy during its passage, comprising a ladle comprising an external metal casing, an internal refractory lining, a channel for the admission of the crude liquid metal at the rear, a nozzle for casting the treated liquid metal at the front and at least one internal partition leaving, with the bottom of the ladle, a space for the circulation of the liquid metal and subdividing the ladle into a first rear compartment and at least one front compartment opening at the casting nozzle; a cradle on which the ladle is fixed; an articulated frame relative to which the said cradle can rock forwards about a first horizontal axis passing through the casting nozzle; and a a platform, the articulated frame being connected to the platform relative to which the articulated frame can rock about a second horizontal axis.

2. A treatment device as claimed in claim 1, in which the first horizontal axis is approximately perpendicular to the direction of flow of the metal in the ladle.

3. A treatment device as claimed in claim 1, in which the second horizontal axis is parallel to the first axis.

4. A treatment device as claimed in claim 1, in which the second horizontal axis is perpendicular to the first axis.

5. A treatment device as claimed in claim 1 which includes an immersion heater for internal heating, a fixed support, and means detachably mounting the immersion heater to the fixed support for movement into and out of the ladle.

6. A treatment device as claimed in claim 1 in which the internal partition is produced from a material which is a good conductor of heat.

7. A treatment device as claimed in claim 1 which includes at least one injector of at least one liquid, solid, gaseous or vaporous treatment agent and a means for supporting said injector.

8. A treatment device as claimed in claim 5 which includes a lifting means for alternately introducing and retracting the immersion heater.

9. A treatment device as claimed in claims 5 and 7 which includes a substantially sealed cover having at least one orifice of which the shape and the dimensions correspond to the shape and dimensions of the support for the immersion heater and the support for the injector so as to permit precise positioning and a substantially sealed connection.

10. A treatment device as claimed in claim 9 which includes a means for releasing the cover.

11. A treatment device as claimed in claim 9 in which the cover comprises, above the rear portion of the first compartment, a portion which can be moved or separated for removing the sullage formed during the treatment.

12. A treatment device as claimed in claim 7 which includes a lifting means for alternately introducing and retracting the injector.

* * * * *